US005824927A

United States Patent [19]

Tonon

[11] Patent Number: 5,824,927

[45] Date of Patent: Oct. 20, 1998

[54] KEYED FREE-REED INSTRUMENTS SCOPE

[76] Inventor: Thomas Tonon, 35 Birch Ave., Princeton, N.J. 08542

[21] Appl. No.: 653,133

[22] Filed: May 24, 1996

[51] Int. Cl.[6] ..... G10D 11/00

[52] U.S. Cl. ..... 84/375; 84/376 R; 84/376 SM

[58] Field of Search ..... 84/375, 376 R, 84/376 K, 376 SM, 350, 360, 361, 362, 363, 364

[56] References Cited

U.S. PATENT DOCUMENTS 2,458,653 1/1949 Seybold ..... 84/376

2,929,291 3/1960 Busilacchio ..... 84/376

2,970,507 2/1961 Bolton ..... 84/350

*Primary Examiner*—Cassandra C. Spyrou

*Assistant Examiner*—Shih-yung Hsieh

*Attorney, Agent, or Firm*—George E. Kersey

[57] ABSTRACT

Improved performance and versatility of a free-reed instrument by linking a key of the instrument to a variable geometry chamber, which provides modifications in musical tones. The instrument can be an accordion or other free-reed instrument, and a passageway of the chamber is manipulated to alter the combined pitch and timbre of the tones.

19 Claims, 9 Drawing Sheets

KEYED FREE-REED INSTRUMENTS SCOPE

This invention relates to sound-producing instruments, and more particularly, to musical instruments having keys and free reeds.

BACKGROUND OF THE INVENTION

Many instruments have free reeds as sound sources. These include accordions, melodeons, concertinas, harmonicas, harmoniums, melodicas, and some organs. The free reeds in such instruments usually are strips of hard material, each having a fixed end, so that the reed resembles a cantilever. The reed is "free" in that it does not contact a rigid surface as it vibrates to produce a characteristic "pitch". Pitch is a perceived attribute of a musical tone in which the relative rapidity of the vibrations producing the tone allows its placement on an ordered musical scale of many tones. The pitch of a vibrating free reed is determined primarily by the reed's natural vibrational frequency.

By contrast, in reed instruments that do not have free reeds, such as the saxophone and clarinet, pitch is determined primarily by the natural vibrational frequency of an air mass defined by the geometry of the instrument. Reeds of these instruments are usually nonmetallic and most often operate as "beating" reeds, in which an immovable wall interferes with vibration. Such reeds usually function as valves that meter energy into standing wave oscillations. Each beating reed can produce a number of musical tones.

However, free-reed instruments have at least one reed for each playable musical tone. In accordions, concertinas, harmoniums, melodeons and similar instruments, airflow is supplied by bellows, which, when squeezed or pulled, produce positive or negative pressure within an air chamber built into the instrument. With the harmonica and melodica, airflow is supplied by breath. The volume, or loudness, of the sound is modified by altering air pressure, and thus, the rate of steady airflow.

To allow digital selection of a particular tone, or group of tones, keys often are provided as controlling mechanical linkages. An example is the use of piano keys, which are used in instruments other than pianos. An assembly of such keys is often called a keyboard. In, for example, some accordions, the keys are in the form of pegs or buttons, with the resulting assembly called a button keyboard. Keys on most wind instruments do not outwardly resemble either a piano or button keyboard, and often are grouped by type along with the family of instruments in which they are found. For instance, reed instruments such as the clarinet and saxophone have similarly constructed keys that cover holes in the body of the instrument, fixing the geometry of the vibrating air column. Brass instruments, such as the trumpet and tuba, have keys that are extensions of valves which modify the length of air-filled tubes within the instrument. Other instruments are often regarded as being keyless. Most stringed instruments, such as the violin and guitar, do not have keys, but there are exceptions which include the piano, harpsichord, and autoharp. These stringed instruments have keys that allow striking, plucking, or pressing against a single string or group of strings.

Keys in free-reed instruments usually transmit finger motion to selector valves, which in turn cause air to pass in the immediate neighborhood of a selected reed. This enables the reed to vibrate. In such instruments, a reed can vibrate, i.e. "speak", only when its selector valve is opened by the motion of a key. With accordions, most associated keys are assembled into boards of either the piano or button type, designated as piano or button accordions. However, the piano accordion conventionally has a piano keyboard on the right-hand, or treble side, and a button keyboard on the left-hand, or bass side. For both the right-hand and left-hand keyboards, the keys are connected to selector valves that open and close air passages associated with reeds. Thus, when there is simultaneous squeezing or pulling of bellows and the pressing of a key, airflow from the bellows causes vibration of the reed for which an air passage is opened by the selector valve connected to the pressed key.

In accordions and similar instruments, one or more sets of reeds often are mounted in reed blocks that are activated during playing. The active reed set is usually determined by the position of slider valves. Once a reed's slider valve is in an open position, and there is non-zero air pressure, it is only necessary to open the associated selector valve in order for the reed to vibrate. A particular reed set will have its own pitch range, or register, and within each set of reeds, there is a separate reed for each playable note. One selector valve may control more than one air passage, in which case the position of the slider valves determines which air passageway permits air-flow through their associated reeds. In some cases, there may be more than one selector valve attached to a given key.

In musical practice, timbre, or quality, distinguishes a musical tone from other tones having the same pitch and loudness and is characterized largely by the number and relative amplitudes of overtones composing the tone. The timbre of free-reed tones is affected by the geometric structure in the vicinity of the vibrating reed. The structure communicates acoustically with the reed. Some accordions have "tone chambers", which are fixed cavities in the vicinity of reed air passageways. These cavities produce sound qualities preferred by some musicians. Tone chambers often require additional selector valves for a given key of the keyboard. The number of sounding reeds also affects timbre. In some cases, the actual vibration of a given reed may be largely unaffected by the presence of other vibrating reeds. The musical tone as heard, however, may be affected, and in such cases, the resultant tone is a linear superposition of all sounding tones at the ear of the listener. In other cases, acoustic coupling between one reed and another is strong enough to cause direct modification in the reed vibration itself, which also results in a modified tone for the listener. In general, acoustic coupling occurs when two or more vibrating components participate interdependently in the same acoustic phenomenon.

An important aspect of the tones produced by most musical instruments, and by free-reed instruments in particular, is the convenience and degree to which the tone is alterable during manipulation of the instrument. While most beating-reed instruments allow the musician to readily alter pitch and timbre, keyed free-reed instruments conventionally do not.

In the accordion, for example, resulting musical tones either sound with relatively constant pitch and timbre, or do not sound at all. Although the musician can alter the loudness of a tone while playing, this alteration has only a minor effect on either pitch or timbre. Some musicians attempt to change the sound of the musical tone by pressing a key minutely in order to partially open a selector valve, but this practice is not precise and can be done only in a restricted manner. Such limitations have restricted the use of keyed free-reed instruments in musical forms such as jazz and blues.

Although the free-reed harmonica, sometimes called a mouth organ, mouth harp, blues harp, or simply, harp, can change tones, this instrument is keyless, and as such, selector valves and many geometric elements influencing timbre are not part of the instrument. Rather, tonal change is supplied by the musician with the tongue and lips serving as selector valves. The hands, mouth parts, throat, nasal cavities, and lungs provide control over both pitch and timbre. By controlling the motion of the hands, mouth, and throat while playing, the harmonica player achieves a substantial range of pitch and timbre from a single free reed. Thus, a "wa—wa" sound can be produced when the musician repeatedly cups hands about the instrument. The harmonica player can make some tones sound flat, often as much as a half tone below the freely sounding tone, enabling a blues scale to be played on a diatonic instrument. This latter technique is sometimes called "pitch bending" and provides colorful variations in both pitch and timbre.

In the illustrative prior art of U.S. Pat. No. 1,735,645, issued Nov. 12, 1929 for "Harmonica", *Hostetter* discloses a finger lever attached to tongues that manually shield one bank of reeds from another in a harmonica, thus allowing the musician to select the reed banks that are playable during either exhaling or inhaling.

In the further illustrative prior art of U.S. Pat. No. 2,565,100 issued Aug. 21, 1951, also for "Harmonica", *Tate* discloses pitch bending by providing, adjacent to wind cells, elongated slots that have two open ends, one of which can be closed in order to produce half tones.

Additionally, in the prior art of U.S. Pat. No. 5,182,413, issued Jan. 26, 1993, also for "Harmonica", *Epping* discloses a method for pitch bending that uses an extra set of enabler reeds and associated valves.

Pitch bending in the harmonica illustrates free reed vibration that is not entirely free in the literal sense. Rather, the vibration is made to acoustically couple with air vibration inside and about an air passageway that participates in the sound. This air passageway may contain additional playing reeds.

Accordingly, it is an object of this invention to improve the performance and versatility of keyed free-reed instruments. Another object is to provide the player of accordions and other keyed free-reed instruments with a facility for altering the pitch and/or timbre of tones, or otherwise modify the sound of the musical tone, while a source reed vibrates, and while the musician is manipulating an instrument.

SUMMARY OF THE INVENTION

In accomplishing the foregoing and related objects, the invention provides an instrument having a key and a free reed for producing a predetermined tone; a chamber of variable geometry associated with the free reed; and a linkage connecting the chamber with the key. As a result, movement of the key causes a further tone that differs from the predetermined tone.

In accordance with one aspect of the invention, the instrument is an accordion, and the key is moved to alter the sound of the reed while it is vibrating. The variable geometry chamber can include a tine of variable position that directly contacts the free reed. The variable geometry can be modified to control the vibration of an air mass therein; so that the further tone is modified by the controlled vibration of the air mass.

In accordance with another aspect of the invention the chamber is a tube having a length no greater than about one-half the wavelength of the fundamental frequency of the first tone.

The vibration of the air mass can be provided by a second free reed that can co-vibrate with the first mentioned free reed. The second free reed produces a predetermined tone in free air of different pitch than the first mentioned predetermined tone.

A key and selector valve can be provided to allow the second free reed to vibrate without co-vibration of the first mentioned free reed; and the key is attached to the selector valve for controlling the vibration of the free reed.

The chamber can be closed, except for a first opening of predetermined size leading to a free reed through a passageway, and a predetermined number of additional openings, with each additional opening sized to produce a second musical tone.

A linkage can provide a predetermined number of movement regimes for the key, including: a regime in which movement of the key is accompanied by a predetermined tone; and an additional regime in which movement of the key is accompanied by the further tone. Movement of the key can be accompanied by a restoring force with a spring constant of one value for the first mentioned regime and a spring constant of a second, different value for the additional regime.

In a method of the invention for producing controllable and alterable combinations of pitch and timbre in a free-reed instrument, the steps include: (a) causing a free reed to vibrate and sound a tone with a prescribed combination of pitch and timbre; and (b) connecting the free reed with an air passageway having a wall, a port in the wall, and a lid for the port; and transmitting motion from a key to the lid of the port to modify the combination of pitch and timbre.

In accordance with one aspect of the method, a further step is to completely uncover the port by the lid to allow the reed to vibrate with the prescribed combination of pitch and timbre. When the port is partially covered by the lid, the combination of pitch and timbre of the tone of the free reed is modified. A further step is to manipulate the port lid by altering its position while the combination of pitch and timbre is being produced.

Another step of the invention is to provide the air passageway as a tube with one end open and the port situated near the reed. The air passageway can be enclosed except for a predetermined number of openings, with a first opening leading to the reed and a second opening identified with the port.

The method further includes the step of vibrating a second reed simultaneously with the free reed; wherein the position of the port lid controls the vibrational amplitude of the second reed. Another step is to close the port lid maximally while allowing a portion of the port to remain uncovered.

The invention also includes the method of making continuous alterations in the musical tone of a vibrating free reed in a musical instrument.

Additionally, the invention provides: 1) a movable element, associated with a vibrating or "speaking" reed of an instrument, in order to control the sound emanating from the reed, and 2) a linkage that connects a key of the instrument to the movable element, which can act directly on the reed, or indirectly. Direct action involves physical contact between the movable element and the vibrating reed. Indirect action occurs when the movable element controls the geometry of an air passageway containing an air mass whose vibration in turn influences the sound of the reed.

In accordance with a further aspect of the invention, a key mechanism allows a musician to digitally alter the position of the movable element associated with the reed. Thus, manipulation of a keyboard allows a musician to alter the sound of the reed as the reed vibrates.

In many free-reed organ pipes, tone pitch is set by adjusting the point of direct contact between a reed and a tongue, or tine. In this manner, the position of the tongue determines the effective vibrational length of the reed. When the tongue is linked to a key, as in the invention, direct modification of the musical tone is allowed by way of the key while the reed vibrates.

In cases where the movable element acts indirectly, numerous possible air passageway geometries are able to vibrate air with sufficient influence on the sound of the vibrating reed. These geometries may or may not contain other vibrating reeds. Consideration is first given to those passageways that contain a vibrating reed and no other vibrating material other than the air contained within and immediately about the passageway. All geometric dimensions of a particular passageway provide many degrees of freedom for proper design. For example, the length, width, volume, and cross sectional shapes of the passageway can each effect the acoustic behavior of air that is set into vibration. From the preferred embodiments described below, other suitable geometries will be apparent.

BRIEF DESCRIPTION OF THE DRAWINGS

Other aspects of the invention will become apparent after considering several illustrative embodiments, taken in conjunction with the drawings, in which.

DETAILED DESCRIPTION

Figure 1B:
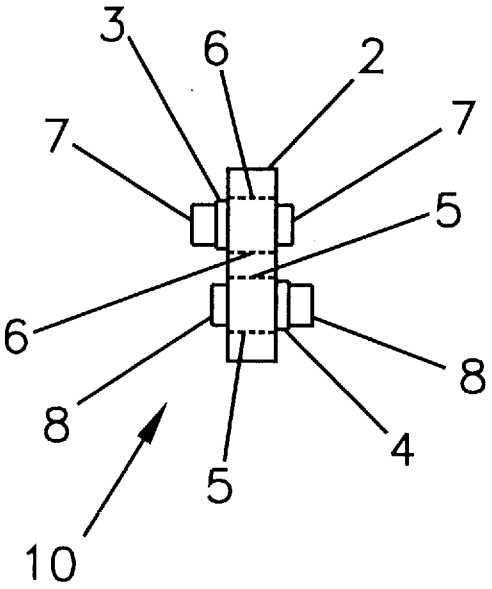
Prior Art Fig. 1b
FIG. 1*b* is a side view of the reed unit of FIG. 1*a;*
Figure 1A:
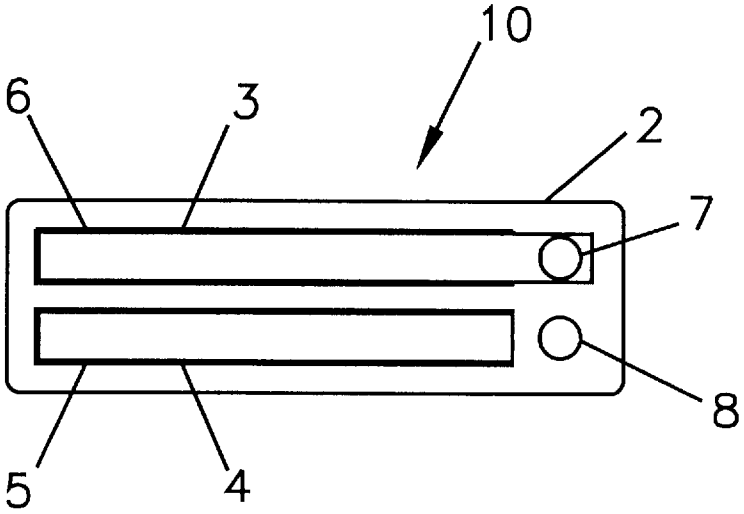
Prior Art Fig. 1a
FIG. 1*a* is a top view depicting a reed unit of typical construction found in many free-reed instruments, including accordions.

With reference to the drawings, FIG. 1*a* is a top view of a reed unit 10 having a construction that is typical to that found in many free reed instruments, including accordions, and FIG. 1*b* is a side view of reed unit 10. Unit 10 includes a reed plate 2 and two reeds 3 and 4, with each reed held in place at one end by rivets 7 and 8, respectively, over respective slots, 6 and 5 in reed plate 2. Reed unit 10 has two reeds 3 and 4 in the same reed plate 2. With some instruments, notably harmonicas, reed units are often made with many reeds attached to one reed plate. As FIGS. 1*a* and 1*b* show, slots 6 and 5 are slightly larger than reeds 3 and 4, so that the reeds can vibrate within their associated slots without interference from reed plate 2. A particular reed vibrates or speaks when air is passed from the reed side of the plate through its associated slot and out the other side of the plate. Thus, when air flows from left to right through slot 6 in FIG. 1*b*, reed 3 speaks, and when air flows right to left through slot 5 in FIG. 1*b*, reed 4 speaks. In some cases, reed 3 has the same tuning as reed 4, and in other cases, the tunings differ. Thus, two different directions of movement of the bellows generating airflow can produce the same, or different, pitches.

Figure 2:
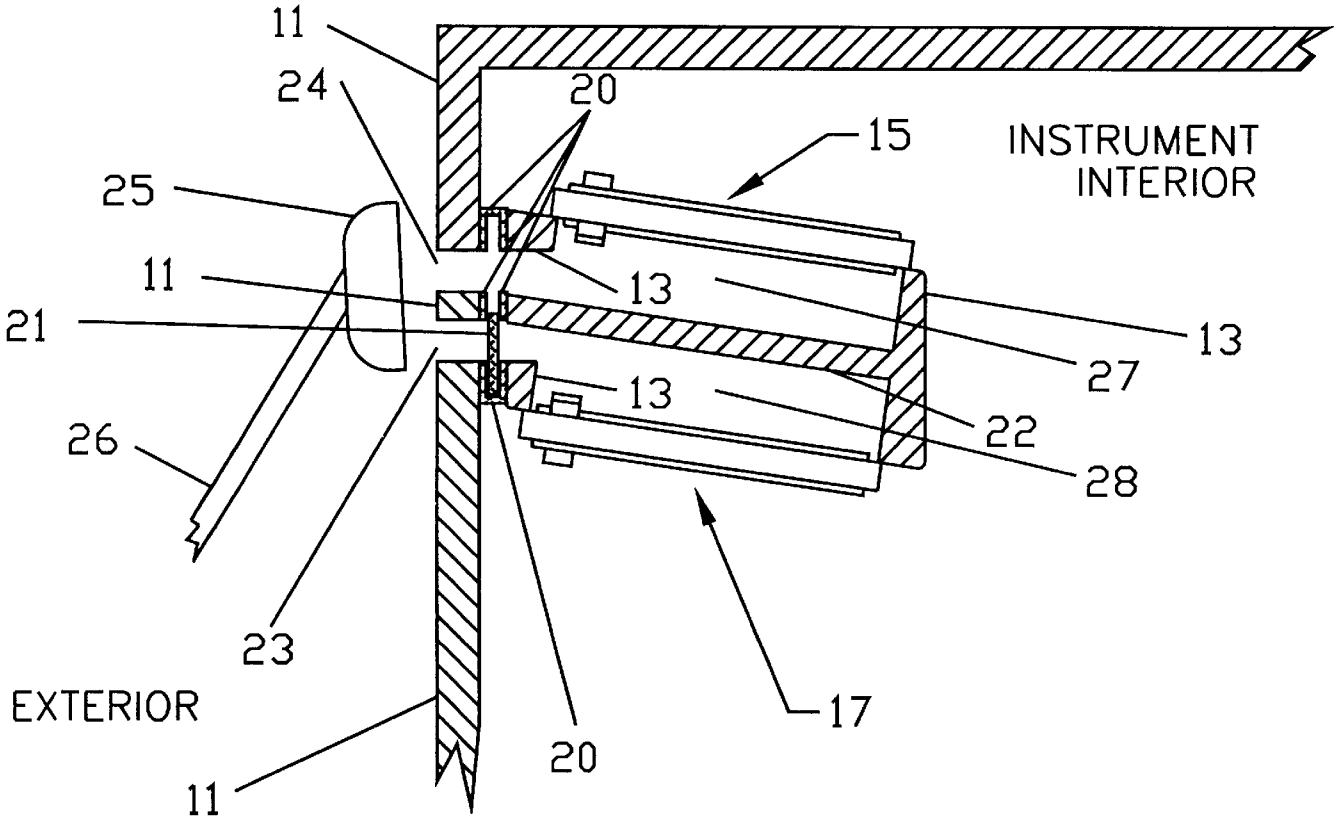
Prior Art Fig. 2
FIG. 2 is a cross-sectional side view of two reed units mounted in a reed block in a manner typical to many free reed instruments, including accordions.

In FIG. 2, reed units 15 and 17 are shown mounted in a reed block 13 in a manner typical to that found in many free-reed instruments, including accordions. Reed block 13 is mounted within the Instrument Interior, as labeled in FIG. 2. Regions Exterior to the instrument are also labeled in FIG. 2. The instrument wall 11 separates the Instrument Interior from the Exterior. In many free reed instruments, the Instrument Interior provides a volume of air that can be compressed or expanded, thus causing air to flow through either, or both, reed units 15 and 17. Whether or not air flows through a given reed unit, and thus, whether or not a given reed unit speaks, depends whether or not the reed unit is connected to the instrument's Exterior by way of an opened air passageway. In FIG. 2, reed block 13 contains a partition 22 that separates the air passageway of reed unit 15 from that of reed unit 17. A slider valve guide 20 is mounted at the mouth of reed block 13. Within slider valve guide 20 are slider valves that control airflow to reed units 15 and 17. In FIG. 2, slider valve 21 is visible and is shown in a closed position covering window 23, which leads to reed unit 17. The slider valve controlling window 24 is not visible in FIG. 2, and is in its open position. Selector valve 25 is shown in an open position, and is large enough to cover both windows 23 and 24 when it is closed. An air passageway associated with reed unit 15 is comprised of window 24 and interior volume 27; whereas, an air passageway associated with reed unit 17 is comprised of window 23 and interior volume 28. With selector valve 25 open and slider valve 21 closed, as depicted in FIG. 2, air can pass only through reed unit 15 when a pressure difference exists between the Instrument Interior and the Exterior. In many free-reed instruments, a rod 26 is used to connect selector valve 25 to one of the instrument's keys, not shown in FIG. 2.

Figure 3:
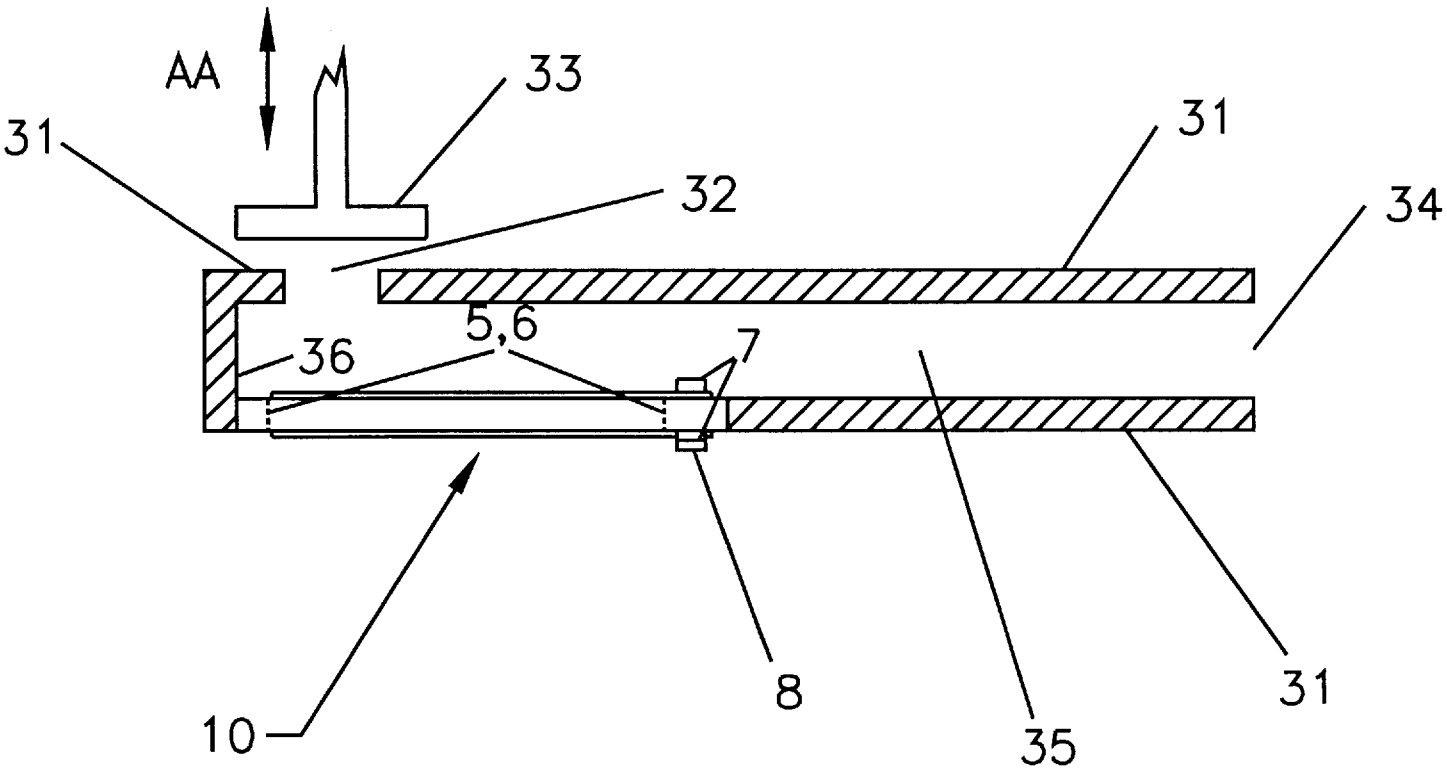
FIG. 3 is a cross-sectional side view showing a reed unit and an associated variable geometry air passageway used in conjunction, with the invention.

FIG. 3 depicts the reed unit 10 of FIGS. 1 and 2 mounted within a variable geometry passageway according to the invention, and includes a simple, straight-sided tube 31, shown in cross section, with an open end 34, a closed end 36, a port 32, and an associated port lid 33. When air flows through reed unit 10, a musical tone results. An air passageway associated with this tone is defined by the interior 35, open end 34, and closed end 36 of tube 31, port 32, and either reed slot 5 or 6, depending upon the direction of airflow through reed unit 10, as explained in the description of FIGS. 1*a* and 1*b*. This air passageway provides a conduit for the airflow that is necessary to cause the reeds of reed unit 10 to speak, resulting in vibration of the air mass that is defined by this passageway. In general, this vibrating air mass also includes, to variable degrees, air immediately outside port 32, open end 34, and which of slots 5 or 6 that is conducting airflow, with resulting sound propagated out and away from the apparatus of FIG. 3. Port lid 33 provides a means to vary the geometry of the air passageway. The motion of port lid 33 is illustrated by arrows AA shown in FIG. 3. A change in geometry of this air passageway, as effected by a change in the position of port lid 33, changes the contribution made by port 32 to the vibrating air mass. When port lid 33 is raised up and away from port 32, most vibration of the air mass is confined near port 32, and air vibration within the interior 35 of tube 31 is minimized. Thus, there is very little acoustic effect of tube 31, and the speaking reed of reed unit 10 vibrates essentially free. When port lid 33 is lowered to a position very close to port 32, significant vibration of the air mass occurs within the interior 35 of tube 31, and strong acoustic coupling is provided between the speaking reed and that part of the air mass within the interior 35 of tube 31. The sound modification feature of tube 31 is then engaged. In particular, the pitch of the musical tone is lowered. Placing reed unit 10 within an apparatus as shown in FIG. 3 thus provides a means to effect sound modification of a free reed by means of a passageway of variable geometry. In accordance with one aspect of the invention, the variable geometry port lid 33 can be linked to a key of a free reed instrument, thus enabling the musician to alter the musical tone of reed unit 10 as the reed unit speaks. Port lid 33 can be mounted in relation to tube 31 by any conventional method used in the mounting of key pads on instruments such as clarinets, etc. It is sometimes useful to mount reed unit 10 in tube 31 by other methods than that depicted in FIG. 3. For instance, while FIG. 3 depicts reed unit 10 mounted such that reed rivets 7 and 8 lie on the side of reed unit 10 farthest from closed end 36, in some applications, it may be more desirable to mount reed unit 10 such that reed rivets 7 and 8 lie on the end of reed unit 10 nearest closed end 36. Or, some applications may require the long axis of reed unit 10 to be mounted at 90 degrees, or at some other angle, to the long axis of tube 31, rather than the zero degree mounting illustrated in FIG. 3.

Figure 4A:
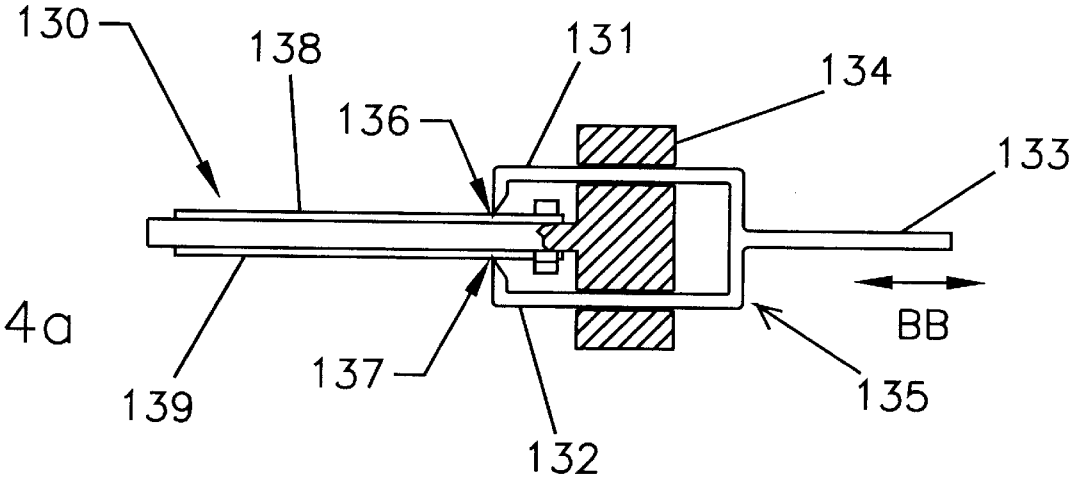
FIG. 4*a* is a cross-sectional side view showing a reed unit and an associated variable geometry element making direct contact with the reed used in conjunction with the invention.
Figure 4B:
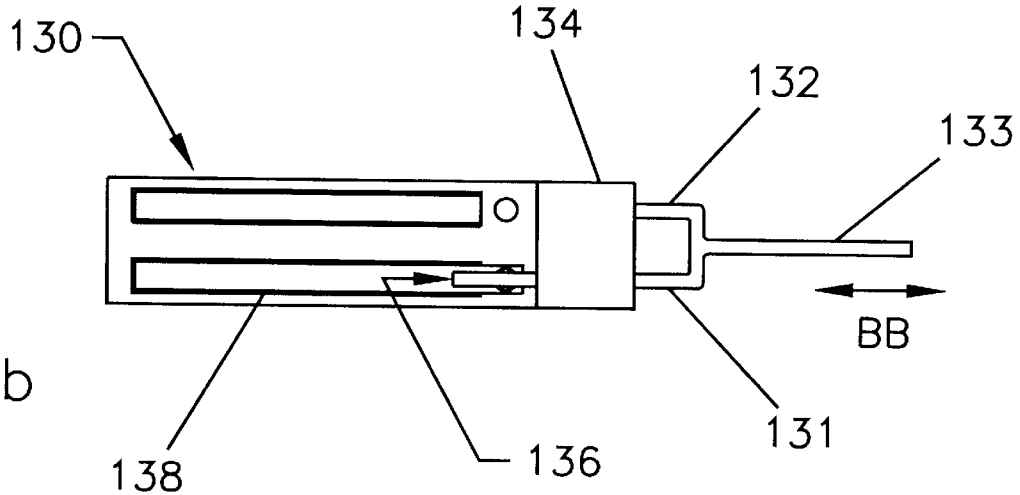
FIG. 4*b* is an end view of the apparatus of FIG. 4*a;*
Figure 5A:
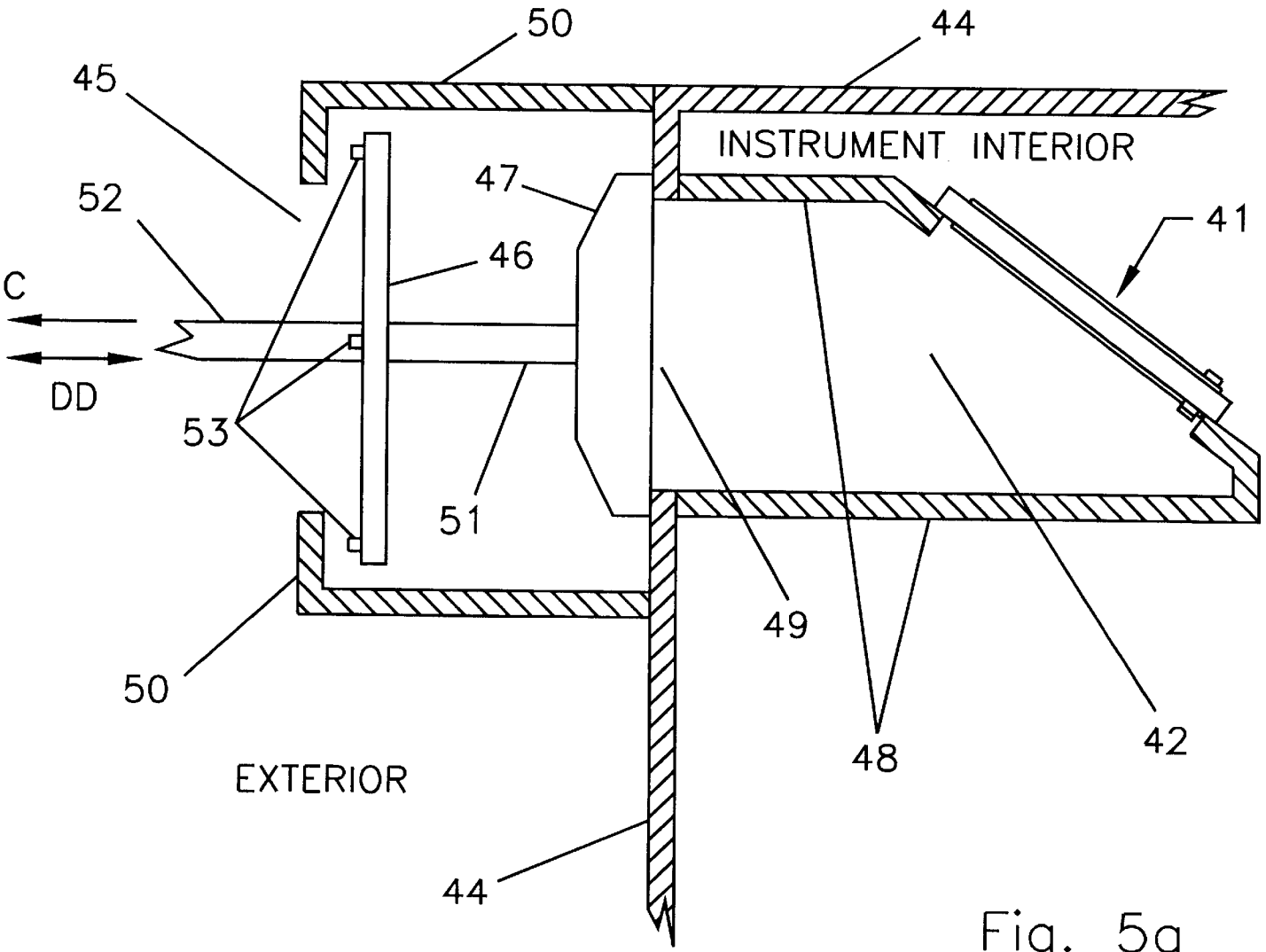
FIG. 5*a* is a cross-sectional side view showing a reed unit associated with an alternative variable geometry air passageway used in conjunction with the invention.
Figure 5B:
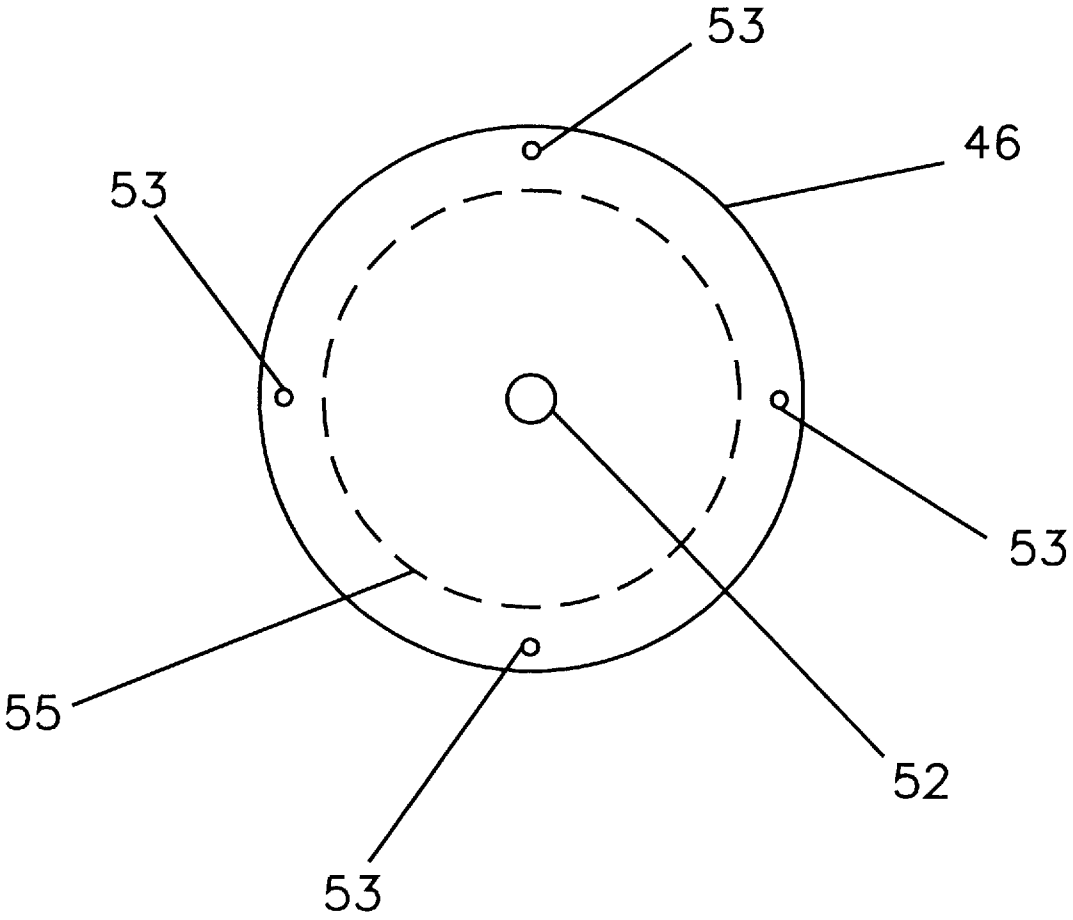
FIG. 5*b* is a detailed end view of the port cover shown in FIG. 5*a;*

FIG. 4*a* is a side view of reed unit 130, in which a metal tongue 135 provides means to alter a musical tone by directly contacting a reed. FIG. 4*b* is a top view of the assembly of FIG. 4*a* and is to be viewed in conjunction with FIG. 4*a*. Tongue 135 is comprised of two separate tines 131 and 132 that directly contact their respective reeds 138 and 139 at points 136 and 137, respectively. Both tines 131 and 132 are joined to stem 133, so that motion of stem 133 in the direction of arrows BB causes points of contact 136 and 137 to move along reeds 138 and 139, respectively. When stem 133 is moved in the direction of the left arrowhead of BB, the effective vibratory length of reeds 138 and 139 is decreased, causing an increase of pitch, whenever a reed speaks. Alternatively, motion of stem 133 back in the direction of the right arrowhead of BB increases the vibratory length of the reeds, resulting in a drop in pitch. Tongues similar to the ones depicted in FIGS. 5*a* and 5*b* are used to tune the pitch of many organ pipes. In accordance with one aspect of the invention, stem 133 can be linked to a key of a free reed instrument, thus enabling the musician to alter the musical tone of reed unit 130 as the reed unit speaks.

FIG. 5*a* depicts the use of a Helmholtz resonator as a variable geometry passageway that can be used in accordance with the invention. In FIG. 5*a*, reed unit 41 is mounted in reed block 48 within an Instrument Interior, separated from the Exterior by partition 44. Selector valve 47 is shown in FIG. 5*a* to be in a closed position, covering window 49. Selector valve 47 is connected to link 51, which is connected to port lid 46, which is in turn connected to rod 52. A component of an air passageway associated with reed unit 41 is the interior volume 42 of reed block 48. When rod 52 is moved in the direction of arrow C, selector valve 47 first uncovers window 49. Air is thus allowed to pass through reed unit 41 by way of air passageway component 42 when a pressure difference exists between the Instrument Interior and the Exterior. With further movement of rod 52 in direction of arrow C, port lid 46 arrives in the vicinity of port 45, which is an opening in wall 50, which is in turn attached to partition 44 of the instrument. At some point, port lid 46 will become close enough to port 45 that the musical tone emanating from the speaking reed of reed unit 41 will become affected and modified. With further movement of rod 52 in the direction of arrow C, the musical tone will be further modified. At this point, if rod 52 is made to move back and forth, in the directions of arrows DD in FIG. 5*a*, a "wa—wa" sound will be attached to the musical tone. In an actual instrument, and in accordance with one aspect of the invention, rod 52 is connected to one of the instrument's keys, not shown in FIG. 5*a*. It is thus explained that, by the presence of link 51, movement of rod 52, via movement of a key of the instrument, provides a first regime of movement in which selector valve 47 opens, allowing a musical tone to play with unmodified sound, and a second regime of movement, in which port lid 46 is intimately near port 45, that provides for modification of the musical tone. Pins 53 attached to port lid 46 serve to reproducibly register the most-closed position of port lid 46 over port 45. With pins 53, it is possible to reproduce the same maximum modification of the musical tone, to maintain this modification in a constant manner, and at the same time, assure that airflow through reed unit 41 is not cut off. With sound modification in effect, the Helmholtz resonator volume is contained within port 45, wall 50, wall 44, reed block 48, and reed unit 41. Air within and about this volume is acoustically coupled to the speaking reed of reed unit 41.

FIG. 5*b* is an end view of the port lid 46 of FIG. 5*a*, showing pins 53, rod 52, and dotted line 55, which defines the outermost boundary of port 45 of FIG. 5*a*. The annular space between the outer boundary of port lid 46 and dotted line 55 is an end view of the volume of air that is confined as port lid 46 moves toward port 45 of FIG. 5*a*. This volume provides a conduit for oscillatory airflow that has proven useful as a design parameter in the construction of some variable geometry air passageways when used in accordance with the invention.

Figure 6:
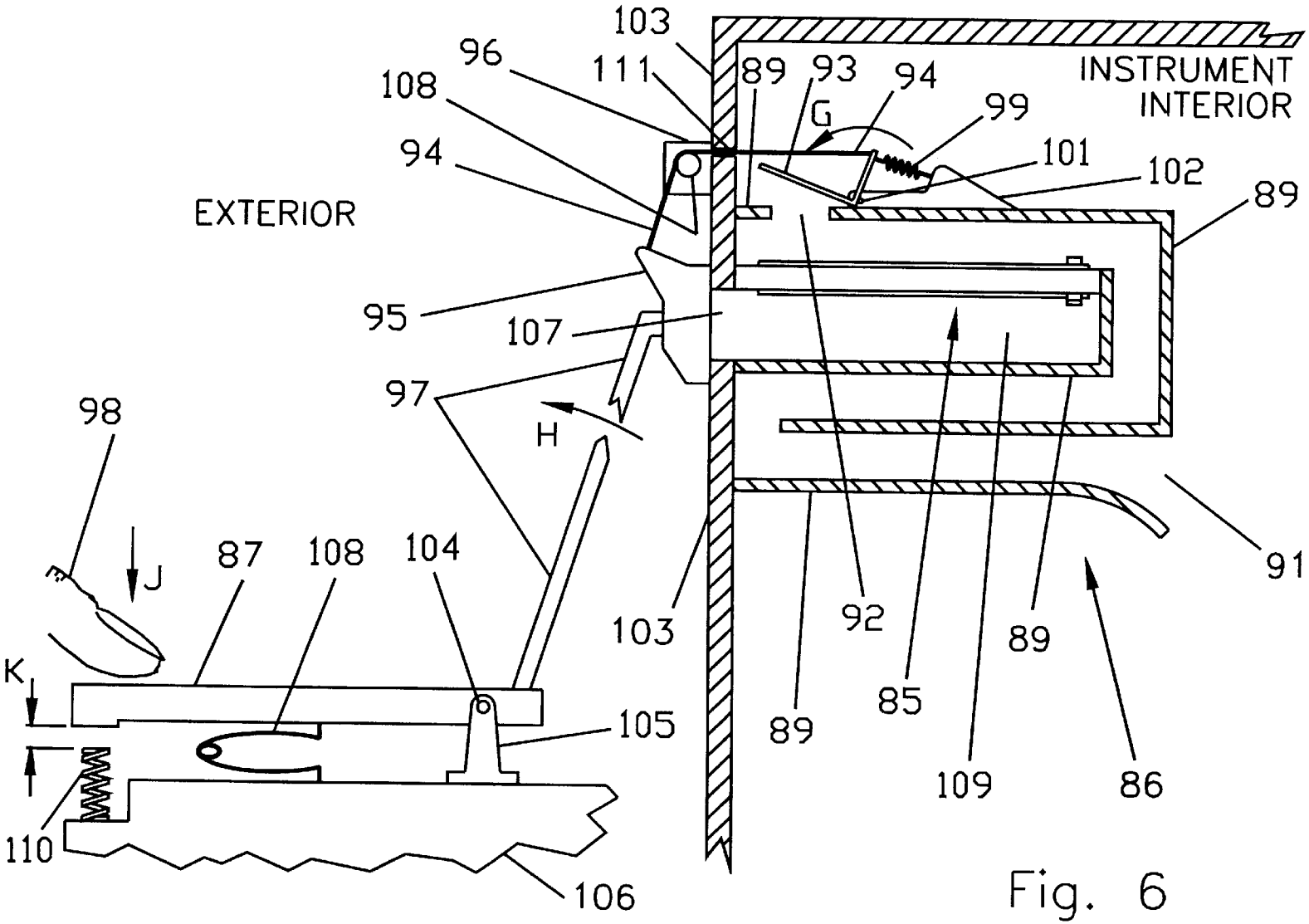
FIG. 6 is a cross-sectional side view showing one adaptation of the invention.

In the embodiment of FIG. 6, the invention is shown in cross-sectional side view with key 87 linked to a variable geometry air passageway mounted within the Instrument Interior, which is separated from the Exterior by wall 103. Reed unit 85 is mounted in one end of tube 86 opposite the other tube end 91 opened to air. In FIG. 6, tube 86 is coiled, or folded back on itself, and is bounded by wall 103 and wall 89. Port lid 93 is supported by pin 101, which is allowed to rotate within bearing 102, which is in turn attached to wall 89. Port lid 93 is shown held in its completely opened position over port 92 by means of spring 99, which connects to port lid 93 and bearing 102. Selector valve 95, whose position shown in FIG. 6 is shown completely closed over window 107, is connected to rod 97, which is in turn connected to key 87. Selector valve 95 is connected to string 94, which loops about pin 108. Pin 108 is supported by bracket 96, which is in turn attached to wall 103. String 94 passes loosely through hole 111 in wall 103, attaching to port lid 93. Key 87 rotates about pin 104, which is held fixed by support 105, which is in turn attached to keyboard frame 106. In some instruments, keyboard frame 106 would support other keys, not shown in FIG. 6, which may be linked to their own selector valve and variable geometry passageway, as depicted in FIG. 6 for key 87. Spring 108 is attached to key 87 and keyboard frame 106 and has a predetermined spring constant, providing a restoring force to the motion of key 87 when the musician's finger 98 changes the position of key 87. When the musician's finger 98 moves downward, in the direction indicated by arrow J of FIG. 6, and presses key 87, moving rod 97 in the direction of arrow H, selector valve 95 first uncovers window 107. Air is thus allowed to pass through reed unit 85 by way of air passageway component 109 when a pressure difference exists between the Instrument Interior and the Exterior, causing a reed in reed unit 85 to speak with a predetermined musical tone. At the same time, because of the linkage provided by string 94, port lid 93 begins to rotate in the direction of arrow G, and key 87 approaches spring 110, closing gap K. No sound modification occurs at first because port lid 93 is still too far away from port 92. Eventually, with further downward movement of the musician's finger 98, gap K will shrink to zero, key 87 will contact spring 110, and port lid 93 will be close enough to port 92 so that modification of the musical tone will begin by virtue of the presence of tube 86. With even further downward movement of the musician's finger 98, the musical tone will be further modified, and spring 110 will provide a restoring force to the motion of key 87. At this point, the total spring constant associated with the restoring force to key 87 will be greater than the spring constant realized with nonzero gap K. It is thus explained that movement of key 87, by means of the linkage supplied by string 94, provides a first regime of key movement, accompanied by one spring constant, that of spring 108, in which selector valve 95 opens, allowing a musical tone to play with unmodified sound, and a second regime of key movement, accompanied by a greater spring constant, that of both springs 108 and 110 acting in unison, in which the proximity of port lid 93 to port 92 provides controllable alterations in musical tone from a speaking free reed. By a proper choice of dimensions for tube 86, string 94, port lid 93, bearing 102 and bracket 96, a desirable amount of maximum musical sound modification can be achieved. FIG. 6 depicts tube end 91 with a bend. This bend can be adjusted in order to provide fine tuning of the effective length of tube 86, much in the way some organ pipes are tuned.

Figure 7:
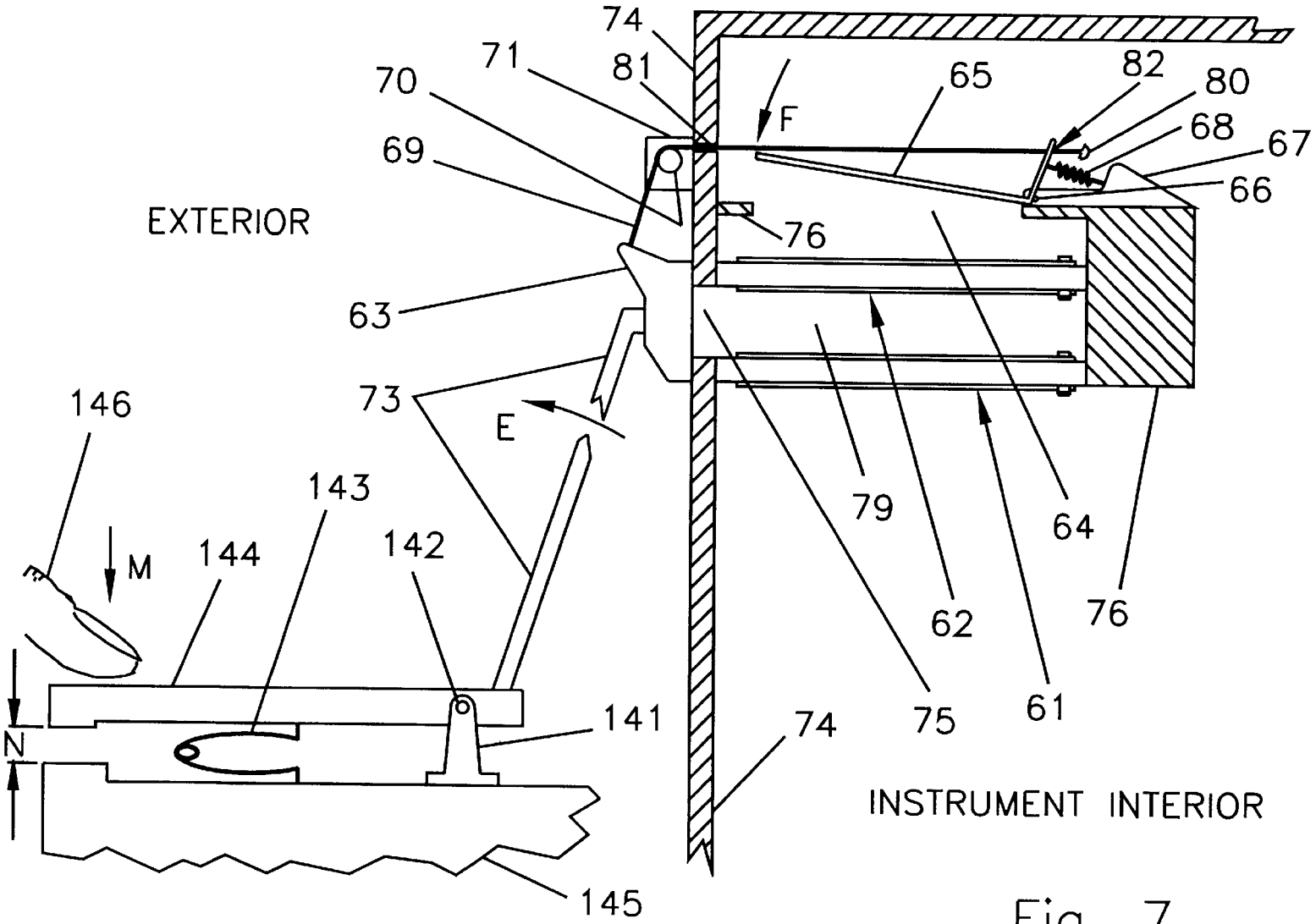
FIG. 7 is a cross-sectional side view showing another adaptation of the invention.

FIG. 7 depicts the use of an additional reed and a variable geometry passageway according to the invention. In FIG. 7, reed unit 61 is mounted in reed block 76 within an Instrument Interior, separated from the Exterior by partition 74. Additional reed 62 is also mounted in reed block 76 and lies just within port 64. Port lid 65 is attached to pin 66, which is allowed to rotate within bearing 67, which is in turn attached to reed block 76. Port lid 65 is shown held open over port 64 by means of spring 68, which connects to port lid 65 and bearing 67. Selector valve 63, shown in FIG. 7 to be in a closed position, covering window 75, is connected to rod 73, which is in turn connected to key 144. Key 144 rotates about pin 142, which is held fixed by support 141, which is in turn fixed to keyboard frame 145. Selector valve 63 is also connected to string 69, which is constructed of a semi-rigid material, such as nylon. String 69 loops about pin 70, which is supported by bracket 71, which is in turn attached to partition 74. String 69 passes loosely through hole 81 in partition 74 and loosely through hole 82 in port lid 65. At some distance from port lid 65, string 69 is terminated by an oversized bulb 80, which cannot be made to pass through hole 82 in port lid 65. When the musician's finger 146 moves downward and pressed key 144 in the direction of arrow M, gap N between key 144 and frame 145 shortens, key 144 rotates about pin 142, and rod 73 rotates in the direction of arrow E, which causes selector valve 63 to open window 75. With window 75 just opened, port lid 65 still uncovers port 64, allowing air to pass through both reed unit 62 and reed unit 61 when a pressure difference exists between the Instrument Interior and the Exterior. This airflow communicates to opened window 75 by means of passageway 79, and the result is a musical tone produced by the combination of two speaking reeds. With further movement of musician's finger 146 in the direction of arrow M, string 69 is pulled further, causing bulb 80 to approach port lid 65. Eventually, bulb 80 will contact port lid 65, and port lid 65 will begin to move in the direction of arrow F, partially closing port 64 and reducing airflow through additional reed unit 62. The sound of the musical tone will thus begin to be modified, because of the reduced contribution due to reed unit 62. With the musician's finger in its furthest downward position, gap N becomes zero, key 144 contacts keyboard frame 145, and port lid 65 will completely cover port 64, totally shutting off reed unit 62 and allowing reed unit 61 to speak with unmodified pitch and timbre. The linkage illustrated in FIG. 7 illustrates a method for key control of a double free reed system where a first regime of key motion produces a musical tone that differs from that of a latter regime of key motion. By a proper choice of predetermined tuning for additional reed unit 62 in relation to the predetermined tuning of reed unit 61, a desirable amount of maximum musical sound modification can be achieved. Alternatively, the linkages of FIG. 7 can be arranged to allow only reed unit 61 to speak in the first regime of key motion, with both reed unit 61 and 62 allowed to speak in a latter regime of key motion. Mounting two reed units in the same reed block, with no partition separating their air passageways, as depicted in FIG. 7, produces strong acoustic coupling between the speaking reeds of reed units 61 and 62, via the air mass common to them. Such coupling provides modification in the sound of the musical tone. It is however also possible to separate the respective air passageways of both reed units and still achieve acceptable sound modification by the means described here. Thus, a partition can be installed in reed block 76 in the way partition 22 of FIG. 2 is installed. With this approach, coplay of reed units 61 and 62 of FIG. 7 produces sound modification by means of linear superposition of the separate sounds made by each reed unit as they are speaking individually, without appreciable modification of their actual vibrations. Thus, reeds with "wet" tuning can be made to characterize a modified tone. One can appreciate that more than two reeds can also be chosen to interact, and thus modify the sound of a musical tone, within a variety of several different mounting methods.

Figure 8:
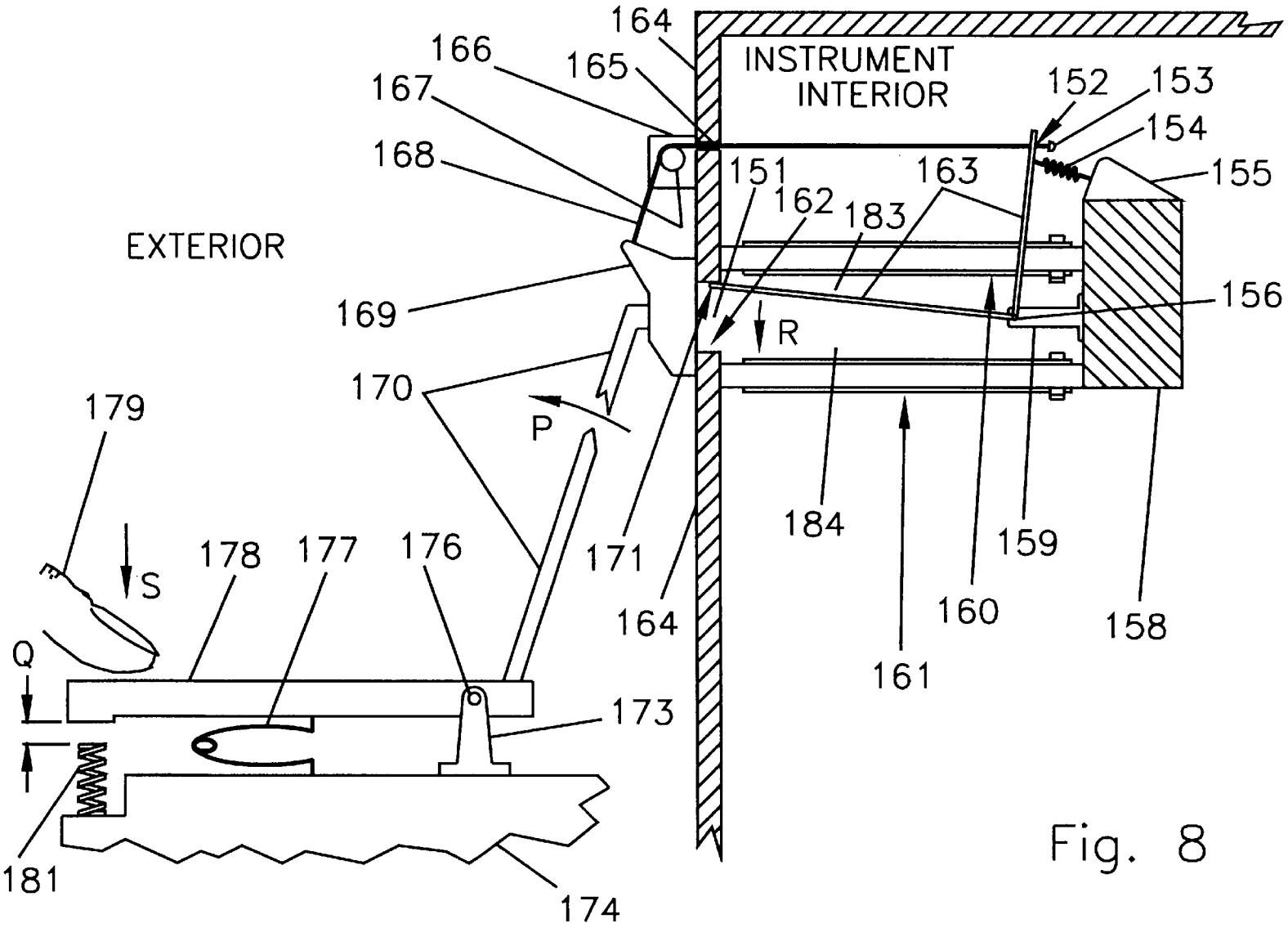
FIG. 8 is a cross-sectional side view of an alternative adaptation of the invention.

FIG. 8 is an alternative adaptation of the invention, showing a variable geometry passageway where both reed unit 160 and reed unit 161 are mounted to reed block 158 inside the Instrument Interior, separated from the Exterior by partition 164. A variable geometry element is port lid 163, which is attached to pin 156 and thus allowed to rotate within support 159, which is in turn attached to block 158. Spring 154 is attached to port lid 163 and support 155, which is rigidly attached to block 158. The tension of spring 154 is normally to keep port lid 163 in contact with partition 164 at position 171 within window 151. In this position, port lid 163 completely covers port 183 leading to reed unit 160 and completely uncovers port 184 leading to reed unit 161. Selector valve 169 is shown in closed position over window 151 and is attached to key 178 by means of rod 170. Key 178 is pierced by and allowed to rotate about pin 176, which is supported by bearing 173, which is in turn attached to keyboard frame 174. Spring 177 is attached to key 178 and to keyboard frame 174 and provides tension that normally keeps selector valve 169 in closed position over window 151. String 168, made of a semi-rigid material such as nylon, is attached to selector valve 169 and loops about pin 167, which is supported by support 166, which is in turn attached to partition 164. String 168 passes loosely through partition 164 by way of hole 165 and also passes loosely through port lid 163 by way of hole 152. At some distance from port lid 163, string 168 terminates in an enlarged bulb 153, which cannot be made to pass through hole 152 in port lid 163. In a first regime of key motion, musician's finger 179 moves downward, in the direction of arrow S, contacting key 178, causing rotation of rod 170 in the direction of arrow P, and in turn causing selector valve 169 to uncover window 151. Eventually gap Q shrinks to zero, key 178 contacts spring 181, and at the same time, bulb 153 contacts port lid 163. In this first regime of key movement, a reed in reed unit 161 is allowed to speak whenever a pressure differential exists between the Instrument Interior and the Exterior. At this time, no reed of reed unit 160 can speak, since port lid 163 blocks airflow through reed unit 160. In a second regime of key motion, the musician's finger presses further on key 178, compressing spring 181 and causing port lid 163 to rotate in the direction of arrow R. Such action opens an airway, by way of port 183, to reed unit 160, allowing a reed there to speak in response to a pressure difference between the Instrument Interior and the Exterior. With no part of port lid 163 in contact with partition 164, both reed unit 160 and reed unit 161 can speak, since both ports 183 and 184 are uncovered; however, downward movement of musician's finger 179 causes port lid 163 to gradually cut off airflow to reed unit 161 and gradually increase airflow to reed unit 160, resulting in a changing musical tone with increasing contribution from reed unit 160. With the most extreme downward position of musician's finger 179, spring 189 is fully compressed and port lid 163 is in contact with partition 164 at position 162. At this extreme end of the second regime of key motion, only reed unit 160 is allowed to speak, for port lid 163 then completely covers port 184 and blocks airflow to reed unit 161.

Although FIGS. 6, 7 and 8 depict only one variable geometry at a time linked to a key of a free reed instrument, the invention also suggests a method for linking more than one variable geometry to the same key, and if so executed, different geometries may be selected. For instance, one can link a variable geometry similar to that depicted in FIG. 5*a* to any of the keys of FIGS. 6, 7, or 8. A useful adaptation of the invention is to link both the variable geometry passageway depicted in FIG. 6 and the tongue of FIGS. 5*a* and 5*b* to the same key, with the arrangement that port lid 93 of FIG. 6 be normally closed, with its opening motion confined to the first movements of the key, and to require the tongue motion to be confined to the second regime of key motion in such a way that depressing further on the key causes the effective vibratory length of the speaking reed to shorten. With such an arrangement, the first instances of key depression are accompanied by a gradually increasing pitch until the pitch becomes normal and predetermined, after which it increases as the key is depressed into its second regime, experiencing an increase in restoring force.

In more general considerations, a convenient passageway geometry that can modify the timbre of free-reed vibrations when linked to a key includes a volume of air within a chamber or container having the free reed mounted in its wall at one position, and one or more holes in its wall elsewhere. This geometry resembles that of a Helmholtz resonator, a particular example of which is shown in FIG. 5*a*. The chief design parameters here are the volume of the container and the total wall hole area. If the wall thickness immediately near a hole is significant in relation to the major dimension of the hole itself, that wall thickness is also an important design parameter. In most cases, the proper choice of design parameters will depend upon the magnitude of the fundamental pitch frequency of the speaking reed. In fact, the resonant frequency of a Helmholtz resonator can be expressed in terms of such design parameters.

Experiments were conducted using such a geometry with a standard accordion reed having a free pitch frequency of 277 hz (C-sharp). This reed was mounted in one wall of a rectangular wooden box with internal dimensions of 4.3 cm×6.5 cm×4.8 cm, and a wall thickness of 0.5 cm. A rectangular hole was made in a wall opposing the reed. The presence of the box dramatically enhanced the loudness of the fundamental frequency and greatly diminished the loudness of the overtones, thus modifying timbre. The maximum effect on a listener occurred when the hole dimensions were approximately 2.4 cm×3.6 cm. Similar results were obtained with a reed of frequency 839 hz, but the maximum effect was obtained with a hole of dimensions 1.7 cm×3.6 cm. In fact, many combinations of box and hole dimensions were found to noticeably affect timbre.

Another preferred passageway geometry is provided by a tube, with the ratio of tube length to major cross sectional dimension somewhat greater than unity. Such a geometry can provide a strong acoustic coupling between the vibrating reed and the air mass within and about the tube, resulting in a modification of pitch in the musical tone. Examples here are included in FIGS. 3 and 6. If the tube cross section is neither excessively large nor small, the length of such a tube, termed a simple tube, is the chief design parameter, and permissible lengths are determined by the natural frequency of the reed vibrating in open air and the desired amount of pitch modification. In most practical cases, the tube length will be approximately one-half the fundamental wavelength associated with the speaking reed, or less. The cross sectional shape, which does not have to be circular or even square, is comparatively not as important as the tube's length. Its sides need not be parallel, and its axis need not be straight. Bends in the axis are permissible, and in fact, space limitations may require that the tube be coiled or folded back on itself as depicted in FIG. 6. In addition, neither the cross sectional area nor the cross sectional shape of the simple tube need be constant from point to point along its axis. Such geometrical features of the tube can be chosen for an optimized design with considerable freedom; however, it is the ratio of tube length to fundamental wavelength that will primarily determine the degree to which pitch bending occurs.

A vibrating reed mounted in a tube, simple or otherwise, and of proper length, will undergo the desired acoustic coupling with air vibrating within the tube when one end of the tube is open, when the other end is closed, and when the reed is mounted sufficiently far from the open end. In fact, some tube designs and reed mounting methods provide coupling that is strong enough to completely mute the reed, even though airflow continues through the reed.

As an example, experiments were performed on a simple tube of variable length with circular cross section of approximately 0.8 cm diameter. One end of this tube was enlarged to accept a standard accordion reed having fundamental free pitch frequency of approximately 262 hz (middle C), and the other end was open to air. Frequency measurements were made on the tones resulting when air was directed through the reed. It was found that the pitch of the tone dropped as the length of the tube increased from essentially the length of the reed up to that approaching a quarter wavelength (31.5 cm). For a tube length of approximately 0.8 times the quarter wavelength, the tone pitch was approximately three half tones below middle C (corresponding to the note A), with reduced loudness. These results were obtained for both inflow and outflow of mean airflow through the reed. At a tube length in the range from approximately one-quarter wavelength to slightly under one-half wavelength, no sound could be obtained from the reed for either inflow or outflow of blown air. For lengths approximately one-half wavelength and even somewhat larger, the musical tone from the reed displayed the free air pitch with enhanced loudness. Similar experiments on a reed having a fundamental free pitch frequency of 880 hz produced qualitatively similar results. The maximum amount of pitch bending, however, at a tube length of about 0.8 times the quarter wave length, was to reduce the sound pitch by only approximately two half tones.

Reducing the diameter of the tube resulted in a drop in sound pitch in addition to the drop otherwise produced. With a tube diameter very small, significantly less than a centimeter across, even a very short tube effectively lowered the pitch of the speaking reed.

Many air passageways with strong acoustic coupling to a free reed can be devised with geometries more complicated than the Helmholtz resonator and the simple tube geometries described above. In fact, many complicated geometries can be produced from combinations of these two simpler geometries. The walls of some of these geometries may be flexible and may even have breaks or openings between adjacent components or to outside air. Flexible walls may be constructed in such a way that their elasticity assists in acoustic coupling with the reed's vibration.

Additional reeds can also be used to modify the sound of the speaking reed by installing them within the same passageway as the original reed, or within their own, nearby passageways. Harmonicas with "soft" tuning are available with two reeds in the same passageway. Epping suggests the use of an enabler reed within the same air passageway as the primary reed, as a means to effect pitch bending in the harmonica. In accordions and other keyed free reed instruments, additional reeds are installed in separate passageways. With proper tuning, these additional reeds are made to "beat" against the sound of the original reed, producing a tremolo, or musette sound. In these latter cases, the sound modification as heard by the listener can be considered to be a linear addition or superposition of the separate reed sounds in the acoustic field common to both reeds.

Considering all geometries and arrangements possible, the actual vibration of the original reed may or may not be directly affected, and it need not be, in order that the listener perceive a modification in musical tone. It is the perceived sound by the listener that detects the presence of a passageway used in accordance with the invention.

An important feature of the invention allows the musician, by means of a key, to modify the position of a movable element that significantly alters the geometry of the passageway that participates in the musical tone. A dimensional or positional change of any chief component of pertinent passageway geometries can be exploited. In particular, lengths, area cross sections, and volumes of geometric components comprising the passageway, as well as passageway routes themselves, can be modified, displaced, or diverted. Suitable valves or tongues can be devised that effect some of these changes, and these may be employed to control additional reeds. In some cases, it may be desirable to construct a particular component of the air passageway from elastic material that can be flexed to change an appropriate dimension of the component. Detailed descriptions cannot be given here for all suitable methods; however, certain preferred embodiments have been described. With any suitable method chosen, linkage to a key is then provided, which allows the musician to digitally effect sound modification during playing.

A simple and effective way to modify the geometry is to provide an opened port, or hole, with an associated port lid, in a passageway wall at a location where an open port greatly modifies the effect of the passageway. For example, using a simple tube passageway as previously described and a hole in the tube wall near enough to the reed, the reed experiences essentially open air and thus speaks with free air pitch. In this case, the cross sectional shape of this port can be whatever is desired, so long as the total port area is not minuscule compared to the cross sectional area of the tube in the vicinity of the port. With such a lid, the musician can cover, partly cover, or otherwise reduce the effective area of the port. With the lid in its most closed position, the sound modification aspect of the passageway is most engaged. It is to be noted that the most closed position of the lid may still leave the port partially open. The musician can thus vary the amount by which the musical tone is modified by singly controlling the position of the port lid.

Sometimes it is not important where the port is located in an outside wall. In the example of the Helmholtz resonator geometries described above, the port can be placed at any convenient position in the wall of the vessel. In order to accommodate the port lid in this adaptation, it is preferable to make the port large enough so that a completely open port prevents any significant acoustic coupling between the speaking reed and the resonator, and to make the port lid large enough so that at least some part of its boundary lies outside the boundary of the port. With the lid in the vicinity of the port, this overlap of the lid can provide a conduit that confines the air vibrating in and out of the port. With closer proximity of the lid to the port, the flow area within this conduit is reduced further, causing increased acoustic coupling between the reed and air within the assembly. The preferred amount by which the port lid extends beyond the port will depend upon the application, and of course, if there are no holes in the resonator wall other than the port, the port lid cannot be made to completely close the port, else airflow will be completely blocked.

In order to determine the effectiveness of a port with a "wa—wa" mechanism, experiments were performed with a standard accordion reed with fundamental free pitch frequency of 280 hz that was placed in one wall of a box constructed of 0.5 cm thick plywood measuring 1.7 cm×4.0 cm×5.2 cm, and a 1.6 cm diameter port was placed in the wall opposite the reed. A port lid measuring 2.7 cm×5.0 cm, i.e. with the same outside dimensions as the wall wherein the port lies, was used to cover the port. Since a completely closed port lid in this case would block the mean airflow through the reed, the most-closed position of the lid was adjusted so that the loudness of the musical tone was not excessively lowered. At the most-closed position at about a millimeter from the wall, the pitch of the musical tone was approximately one-quarter tone below its free pitch experienced by the reed with an entirely open port. The lower frequency components of the sound were enhanced, and the higher overtones were dramatically filtered out. This example illustrates that the component of the air passageway between the overlap of the port lid and the resonator wall in proximity to the lid, because of its relatively long length, contributes acoustic coupling that lowers the pitch of the speaking reed. When the 280 hz reed was replaced by a 840 hz reed, the pitch bending effect was negligible, resulting in only a 10 percent drop in pitch, although the most-closed position of the port lid did produce a tone with richer contribution from lower frequency components. In other words, timbre was primarily influenced. This latter experiment illustrates the important role that the fundamental free pitch frequency can have on the acoustic coupling in a given geometry. With this geometry, repeated manipulation of the port lid while using either the 280 hz reed or the 840 hz reed produced the familiar "wa—wa" sound achievable with the harmonica, because of a cyclic change in both pitch and timbre, or in timbre alone.

The port and an associated lid, or any convenient change in passageway geometry, can facilitate the use of acoustic passageways that, in the absence of the port and because of profound acoustic coupling, would completely stop reed vibration. In these cases, reed vibration can be maintained by only partially engaging the acoustic coupling. The experimental results presented earlier show that certain lengths of a simple tube completely muted the reed. In these experiments, it was also found that a port lid that is never completely closed allows the use of all tube lengths between one-quarter and one-half wavelength, with which no sound would be produced in the absence of the port.

As a further refinement, it may be desirable in some applications to provide the port lid with a tab that would allow the port, in its most-closed position, to form a reproducibly small effective opening of the port as depicted in FIG. 5*a*. In other cases, small extensions of the port itself outside the area controlled by the port lid, or a small hole in the port lid, may also provide a reproducible registration of the most-closed position of the port lid. Apart from their more obvious advantages, such refinements can also be made to affect the relative amounts of the modifications that occur in pitch and in timbre, and thus increase flexibility in design.

In U.S. Pat. No. 2,565,100, Tate uses a slot of width comparable to that of a harmonica reed, and of length generally much less than one-quarter wavelength, in order to effect pitch blending in the harmonica. Tate's slot is essentially a tube having a length approximately equal to the width of the harmonica, typically about 2.5 cm. If this length were used for a tube at 0.8×one-quarter wavelength, the acoustic wavelength would be 2.5×4/0.8, or 12.5 cm, corresponding to a fundamental acoustic frequency of about 2640 hz. From the experimental results, tubes of this length with cross sections large enough to eliminate frictional effects would pitch bend only reeds with free vibrations greater than about 2640 hz. Commercial harmonicas are manufactured as a class with tones typically in the range from G, at 392 hz, to F'", at 2960 hz, encompassing 36 musical tones. A frequency of 2640 hz lies near E'" (at 2637 hz). Thus, such tubes of 2.5 cm length, or less, could most effectively bend only three or four tones at the highest end of the 36 tones available to commercial harmonicas. The conclusion is that Tate's short tube method of pitch bending must rely on frictional effects. In fact, Tate's tubes, being only as wide as a single harmonica reed, are narrow enough to accomodate appreciable viscous dissipation, and must significantly reduce the volume of the speaking reed.

For accordions, the reed plates are typically much wider than the widths of reeds, providing ample room for pitch bending tubes to operate with little viscous effect.

In the approach taken by Epping in U.S. Pat. No. 5,182,413, an enabler reed tuned to a pitch lower than the sounding reed is placed within the same air passageway as the primary reed and is used to pull down the pitch of the primary reed when the musician blows in a particular way to open the enabler valve. This approach to pitch bending can be exploited in the present invention by replacing the enabler valve by a rigid and rotatable flapper that is linked to a key mechanism digitally controlled by the musician.

Hostetter in U.S. Pat. No. 1,735,645 allows the musician to switch the activity of two reed sets, preferably the dominant and subdominant reed sets, in a harmonica by a tongue that shields either set from airflow when manipulated as desired by the musician via a finger lever. The function of this tongue is to allow a reed of either set to speak singly, and to preclude a reed of either set from speaking simultaneously with a reed of the other set. The invention, however, provides novelty in several ways. In some cases, the tongue of the invention allows only one of the reed sets to be active and purposefully allows coplay of two separate reeds. In other adaptations of the invention in which either of two reed sets can be active, a linkage connects the tongue to an existing key of the instrument, a key to which a selector valve is attached, and a key which is nonexistent in the harmonica.

In adapting the method of the invention, it may be desirable to place additional reeds within their own air passageway; i.e., external to the original reed passageway. Accordions with "soft," "wet," or "musette" tuning exhibit such an arrangement of reeds. In these cases, each air passageway often has its own slider valve and may or may not share a selector valve with another passageway. The port lid of the invention in this case can take the shape of a movable rigid flapper, linked to a key, that can be made to cover completely, partially, or not at all, any additional reeds meant to coplay with the original reed. The musician can then play any additional reed at will, and so produce the desired sound modification, by motion of the key to which the flapper is attached. Sound modification in this latter adaptation may include a tremolo effect due to the production of beats.

The linkage that controls any movable geometric element affecting sound modification can be accomplished in several ways. It is feasible that this linkage can be separated from the keys that control selector valves and attached to a key that is dedicated entirely to sound modification. However, it is preferred that this linkage be attached to the very key that controls the selector valve. In this way, the musician will be less encumbered and thus better suited to manipulate the sounds he or she is producing.

Another preferred linkage configuration enables the motion of the key to be divided into two or more regimes. One regime is identical to the conventional manner in which a key functions; i.e., key motion merely opens one or more reed air passageways by means of one or more selector valves, allowing a musical tone to sound with normal pitch and timbre. A second regime provides pitch and/or timbre alteration. Thus, the invention allows the normal tone of the reed when the key is pressed initially and through the initial part of its total travel (first regime), and for the alteration in sound when the key is pressed further, to the end of its travel (second regime). In such an adaptation of the invention, the second regime can be made to exhibit an increased resistance to motion, thereby giving physical feedback via the musician's fingers when sound alteration is occurring. This last adaptation is especially suitable when there is only one direction of key motion. A more complicated multi-directional adaptation can be provided by a key that moves first in one direction (first regime, first direction), allowing the normal musical tone, then in another direction (second regime, second direction), allowing the alteration in tone. It is of course possible to combine a two-regime linear key motion with the more complicated multi-directional regime.

Some electronic instruments with keyboards having "after touch" or "touch sensitive" keys allowe musician to alter the sound of the musical tone while playing, and often exhibit double-regime operation. Such electronic keyboards stake no claim to this invention. Indeed, such keyboards are not readily adaptable to free reed acoustic instruments, since their use evolved with electronic know-how that is particularly suited to modify electronically generated musical tones. The construction of such electronic keyboards involves the use of electrical components such as switches and potentiometers that modify electrical signal voltages and are not used in conjunction with acoustically designed passageways in free reed instruments. The novelty presented here is substantially of a different nature, which adapts mechanical linkages to acoustic passageways in free reed instruments, and has heretofore no precedent.

For economy of construction, each key of the instrument can be connected to the same linkage that effects the modification in sound. For instance, pressing any key into a second regime will engage sound modification for all keys. Although this latter adaptation may be less costly to manufacture, linking each key separately to only the variable geometric elements associated with that key increases flexibility and should greatly assist musicianship during manipulation of the instrument.

A possible physical understanding of the acoustic effect of a variable geometry air passageway according to the invention can be obtained through study of complex acoustic impedance, defined by the ratio of oscillatory sound pressure to oscillatory air volume flow. The real part of this ratio, called resistance, is determined by energy loss mechanisms, and the imaginary part, called reactance, is determined by kinetic and potential energy storage mechanisms. The behavior of the reed vibration is believed to depend upon the impedance experienced by the reed. A vibrating reed in open air experiences very little reactive impedance since free air has little kinetic and potential energy storage capacity. Almost all of the sound energy generated by the reed is lost from the system by a wave traveling to the far field and is described primarily by resistance. Placing the reed in a passageway alters the impedance experienced by the reed.

An understanding of the mechanical system is facilitated by reference to its electric circuit equivalent. The acoustic behavior of a Helmholtz resonator is considered to be analogous to the electrical behavior of a series-connected capacitor-inductor-resistor string. Such a series circuit offers very little electrical impedance at the resonant frequency. Likewise, quarter wave tubes having one end open and the other closed are analogous to an electrical circuit with a capacitor in parallel with a series combination of an inductor and a resistor. The impedance of this configuration at the closed end becomes very high at resonance. Series and parallel resonant circuits, as well as their combinations, have proven useful in the design of passive circuit filters. Flexibility is offered to free-reed instrument designers by considering their acoustic analogues, the Helmholtz resonator and the simple tube. The reactive part of the acoustic impedance presented by a passageway generally is a function of acoustic frequency. Thus, with the Helmholtz geometry, amplification of the fundamental vibrational frequency dominates any amplification of higher overtones, and the effect of a simple tube on the sound of the reed varies with the length of the tube. The real part of the impedance can also play a significant role in sound modification of a free reed. Friction in the acoustically coupled air passageway serves to limit the amplification of standing wave oscillations and often is more effective with higher harmonics. Such behavior affects the timbre of a musical tone. Also, the natural vibrational frequency of a system is modified by the amount of friction that is present. Frictional effects, due to viscous air resistance, can explain the importance of the overlap of the port cover, as discussed above in conjunction with FIGS. 5*a* and 5*b*, and can also serve to explain the behavior of the simple tube of relatively short length described wherein a change to a smaller diameter results in lowered pitch. The increased viscous air friction on the walls of the smaller diameter tube loads the reed's vibration and reduces its resonant frequency. Lastly, when there are other active vibrating components, such as additional reeds, present in the passageway, the vibration of the original reed can be described by the impedance presented to it by these other components, acting in concert with the unifying component of air within which all components are immersed.

It will be appreciated that the foregoing physical interpretation of the behavior of the acoustic passageway associated with the invention is only an attempt to relate several concepts, and that its degree of accuracy, or inaccuracy, has no bearing upon the usefulness, novelty, or originality of the invention.

It will also be appreciated that the foregoing description of the invention is illustrative only, and that modifications and adaptations of the illustrative embodiments may be made without departing from the spirit and scope of the invention, as defined in the appended claims.

What is claimed:

1. The method of producing controllable and alterable combinations of pitch and timbre in a free reed musical instrument, comprising the steps of:

(a) causing a free reed to vibrate within a chamber of variable geometry and sound a tone with a prescribed combination of pitch and timbre; and (b) connecting said free reed with an air passageway having a wall, a port in said wall and lid for said port; and (c) transmitting motion from a key to said lid of said port; thereby to modify said combination of pitch and timbre.

2. The method of claim 1 further including the step of completely uncovering said port by said lid;

thereby allowing said reed to vibrate with said prescribed combination of pitch and timbre.

3. The method as defined in claim 1 further including the step of partially covering said port by said lid;

whereby the combination of pitch and timbre of the tone of said free reed is modified.

4. The method as defined in claim 1 further including the step of manipulating said port lid by altering its position while said combination of pitch and timbre is being produced.

5. The method as defined in claim 1 further including the step of providing said air passageway as a tube with one end open and said port situated near said reed.

6. The method as defined in claim 1 further including the step of vibrating a second reed simultaneously with said free reed;

wherein the position of said port lid controls the vibrational amplitude of said second reed.

7. The method as defined in claim 1 further including the step of closing said port lid maximally while allowing a portion of said port to remain uncovered.

8. Apparatus comprising an instrument having a key attached to a selector valve for controlling the vibration of a free reed for producing a predetermined tone;

a chamber of variable geometry associated with said free reed further including means for modifying said chamber to control the vibration of an air mass therein;

a linkage connecting said chamber with said key whereby movement of said key causes a further tone that differs from said predetermined tone and is modified by the controlled vibration of said air mass, being provided by a second free reed that can co-vibrate with the first mentioned free reed;

further including means for allowing said second free reed to vibrate without co-vibration of said first mentioned free reed.

9. Apparatus as defined in claim 8 wherein said instrument is an accordion, and said key is moved to alter the sound of said reed while it is vibrating.

10. Apparatus as defined in claim 8 wherein said variable geometry chamber includes a tine of variable position that directly contacts said free reed.

11. Apparatus comprising an instrument having a key and a free reed for producing a predetermined tone;

a chamber of variable geometry associated with said free reed;

a linkage connecting said chamber with said key;

whereby movement of said key causes a further tone that differs from said predetermined tone;

further including means for modifying said variable geometry chamber to control the vibration of an air mass therein;

whereby said second musical tone is modified by the controlled vibration of said air mass;

said chamber being closed except for a first opening of predetermined size leading to said free reed through a passageway, and a predetermined number of additional openings, with each additional opening sized to produce said second musical tone.

12. Apparatus as defined in claim 11 wherein said instrument is an accordion, and said key is moved to alter the sound of said reed while it is vibrating and said variable geometry chamber includes a tine of variable position that directly contacts said free reed.

13. The method of producing controllable and alterable combinations of pitch and timbre in a free reed musical instrument, comprising the steps of:

(a) causing a free reed to vibrate and sound a tone with a prescribed combination of pitch and timbre; and (b) connecting said free reed with an air passageway having a wall, a port in said wall and lid for said port; and (c) transmitting motion from a key to said lid of said port; thereby to modify said combination of pitch and timbre;

further including the step of enclosing said air passageway except for a predetermined number of openings, with a first opening leading to said reed and a second opening identified with said port.

14. Apparatus comprising an instrument having a key and a free reed for producing a predetermined tone;

a chamber of variable geometry containing said free reed; and a linkage connecting said chamber with said key;

whereby movement of said key causes a further tone that differs from said predetermined tone;

wherein said linkage provides a predetermined number of movement regimes for said key, including:

a regime in which one movement of said key is accompanied by a predetermined tone; and an additional regime in which a different movement of said key is accompanied by said further tone.

15. Apparatus as defined in claim 14 further including means for modifying said variable geometry chamber to control the vibration of an air mass therein;

whereby said second musical tone is modified by the controlled vibration of said air mass.

16. Apparatus as defined in claim 15 wherein said chamber comprises a tube having a length less than one-half of the wavelength of the fundamental frequency of said first tone.

17. Apparatus as defined in claim 15 wherein said vibration of said air mass is provided by a second free reed that can co-vibrate with said first mentioned free reed.

18. Apparatus as defined in claim 17 wherein said second free reed produces a predetermined tone in free air of different pitch than said first mentioned predetermined tone.

19. Apparatus as defined in claim 14 wherein said one movement of said key is accompanied by a restoring force with a spring constant of one value for said first mentioned regime and a spring constant of a second, different value for said different movement of said additional regime.

* * * * *